US009050617B2

(12) United States Patent
Weitkamp et al.

(10) Patent No.: US 9,050,617 B2
(45) Date of Patent: Jun. 9, 2015

(54) SELF-CLEANING NOZZLE FOR APPLYING ADHESIVE TO A MOVING WEB

(75) Inventors: Juergen Weitkamp, Ahaus (DE); Marcus Schoenbeck, Versmold (DE)

(73) Assignee: MONDI GRONAU GMBH, Gronau (DE)

( * ) Notice: Subject to any disclaimer, the term of this patent is extended or adjusted under 35 U.S.C. 154(b) by 212 days.

(21) Appl. No.: 13/439,945

(22) Filed: Apr. 5, 2012

(65) Prior Publication Data

US 2012/0263873 A1 Oct. 18, 2012

(30) Foreign Application Priority Data

Apr. 14, 2011 (DE) ..... 10 2011 002 069

(51) Int. Cl.
*B05C 5/00* (2006.01)
*B05C 5/02* (2006.01)
*B05B 15/02* (2006.01)

(52) U.S. Cl.
CPC ..... *B05C 5/0245* (2013.01); *B05B 15/0258* (2013.01)

(58) Field of Classification Search
CPC ..... B05C 5/0245
USPC ..... 118/300, 325; 427/207.1, 356; 156/578; 425/72.1, 461; 239/589, 599, 601, 602, 239/590.5, 290, 291
See application file for complete search history.

(56) References Cited

U.S. PATENT DOCUMENTS 4,719,963 A * 1/1988 Schenk et al. ..... 164/461
2006/0068113 A1* 3/2006 Aoyama et al. ..... 427/356

* cited by examiner

*Primary Examiner* — Yewebdar Tadesse
(74) *Attorney, Agent, or Firm* — Andrew Wilford

(57) ABSTRACT

A nozzle for applying a liquid adhesive to a web moving continuously in a travel direction has a body having a passage forming an outlet opening generally transversely to the direction immediately adjacent the moving web at a face of the body so that the liquid adhesive flows through the passage and out the outlet end onto the moving web. Structure on the face of the body forms immediately upstream of the outlet a porous region. Air is fed through the structure and out of the face to form between the region and the web an air cushion.

10 Claims, 1 Drawing Sheet

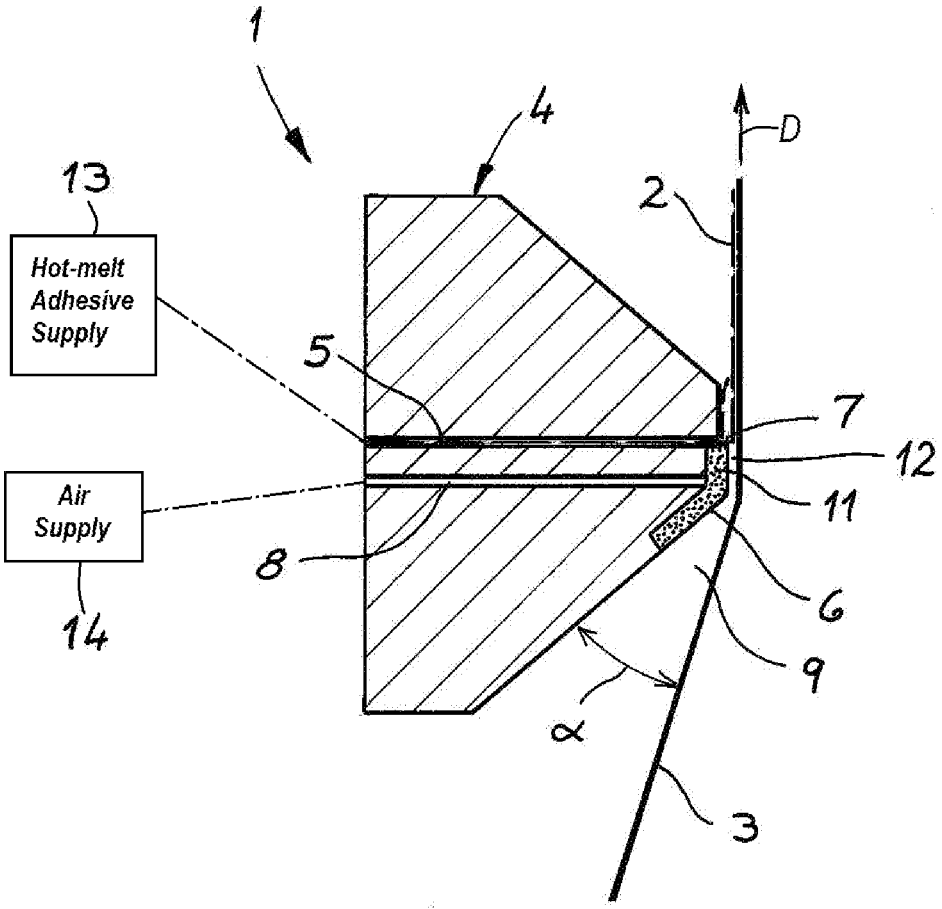
1
4
D
13
2
Hot-melt
Adhesive
Supply
5
7
12
Air
Supply
11
8
6
14
9
α
3

SELF-CLEANING NOZZLE FOR APPLYING ADHESIVE TO A MOVING WEB

FIELD OF THE INVENTION

The present invention relates to an adhesive nozzle. More particularly this invention concerns a nozzle for applying adhesive to a moving web.

BACKGROUND OF THE INVENTION

A typical nozzle for applying an adhesive to a continuously moving web has a body formed with a passage for feeding the adhesive and having a guide face directed toward the web and upstream in the travel direction of an outlet end of the passage.

This nozzle for applying adhesive can be used in particular for laminating nonwovens against themselves or against films. The nozzle applies heated adhesive, typically a hot-melt, to a moving web constituted by the nonwoven. To this end, the web rides on the guide face. The pressure with which the web is moved over the guide face results in friction and abrasion on the web. As a consequence, fibers of the web deposit on the nozzle. For reducing friction and avoiding deposits, the guide face is often provided with a slide coating, for example a PTFE coating. The passive coating can be further improved by surface burnishing. However, the known slide coatings wear relatively quickly. Experience has shown that the slide coating on a guide face of a nozzle has to be renewed every four to six weeks.

OBJECTS OF THE INVENTION

It is therefore an object of the present invention to provide an improved nozzle for applying adhesive to a moving web.

Another object is the provision of such an improved nozzle for applying adhesive to a moving web that overcomes the above-given disadvantages, in particular that is maintenance-free and cleans itself.

SUMMARY OF THE INVENTION

A nozzle for applying a liquid adhesive to a web moving continuously in a travel direction has according to the invention a body having a passage forming an outlet opening generally transversely to the direction immediately adjacent the moving web at a face of the body so that the liquid adhesive flows through the passage and out the outlet end onto the moving web. Structure on the face of the body forms immediately upstream of the outlet a porous region. Air is fed through the structure and out of the face to form between the region and the web an air cushion.

The air passage according to the invention can be laterally or on the upstream side of the guide face. With the configuration according to the invention of the nozzle, the air cushion is formed between the web running along the guide face and the guide face by the stream of air that flows out in this region. The air cushion prevents frictional contact between the guide face and the web or at least reduces this contact. This way, abrasion of the web can be avoided and wear of the guide face can be prevented. The nozzle's guide face configured according to the invention is maintenance-free. If fibers or other particles disengage from the web, the fibers or constituents are transported away by the outflowing air. Thus, the nozzle has a self-cleaning effect for this region.

The guide face of the body preferably has angled sections that border an inflow gap in the travel direction of the web.

The angled sections are formed as two legs, one of which forms an acute angle a with the web moving in the travel direction and the other leg extending parallel to the moving web. Another configuration possibility provides a guide face that is arcuately curved.

The guide face is advantageously formed from a porous molding. It preferably has an open-cell pore structure. The molding can be made in particular of metal foam or a sintered metal and preferably has very small pores that are not visible with the naked eye so that air can be fed through them. Advantageously, the porous molding is designed for a air-flow rate of 0.1 to 10 l/(min. $cm^2_{outlet\ area}$).

According to the invention, the described nozzle is used in particular for applying a hot-melt adhesive, that is a thermal fusion adhesive, to a moving web made from a nonwoven. Hot-melt adhesives are characterized in particular by permanent adhesiveness in the permanently elastic state. These special properties of the hot-melt adhesive are in particular suitable for use on porous or fibrous material surfaces such as a nonwoven. For processing, the hot-melt is heated in the heatable passage to a temperature of, for example, 100 to 200° C. and applied to the web by the nozzle.

The stream of air flowing out of the porous guide face is preferably controlled in such a manner that an air cushion is formed between the guide face and the web that prevents or at least reduces direct contact between the web and the guide face. The air cushion can be varied by regulating the air supply. Advantageously, the air-flow rate through the guide face of the nozzle is set in a range from 0.2 l to 0.5 l per $cm^2$ of outlet area per minute.

According to the invention, a web moving in the travel direction is directed by the formed air cushion in a contactless manner or at least without substantial frictional contact along the guide face of the nozzle. This results in a gentle web guidance of the nonwoven web and avoidance of abrasion. Individual particles and fibers that disengage from the web and get into the inflow gap between the web and a leg of the guide face extending at an angle $\alpha$ can be transported away by the stream of air there. Thus, self-cleaning of the nozzle from deposits is ensured.

BRIEF DESCRIPTION OF THE DRAWING

The above and other objects, features, and advantages will become more readily apparent from the following description, reference being made to the accompanying drawing whose sole FIGURE is a partly sectional schematic view of the invention.

DETAILED DESCRIPTION

As seen in the drawing a nozzle 1 applies an adhesive 2 from a supply 13 to a moving web 3, here a nonwoven moving in a travel direction D. The principal structure of the nozzle 1 includes a body 4 with a heatable passage 5 for feeding the adhesive 2. The body 4 has a guide face 6 directed toward the web 3 and that, viewed in the travel direction D of the web 3, is upstream of an outlet 7 of the heatable passage 5. The guide face 6 is porous, and a stream of air that can be fed from a supply 14 through an air passage 8 from the back face of the guide face 6 flows through the guide face 6. The guide face 6 has angled subfaces that delimit an inflow gap 9 in the travel direction of the web 3. The gap 9 is of decreasing width in the travel direction D. The angled subfaces are formed by two legs, one of which forms an acute angle a of somewhat less than 45° with the web 3 moving in the travel direction D and the other leg of which is parallel to the moving web 3. The guide face 6 can also be arcuately curved.

The guide face 6 is formed by a porous molding 11 set flush in the nozzle body 4. The molding 11 is made of sintered metal that has very small pores not visible with the naked eye so that air can be fed therethrough from the pressurized supply 14 typically comprised of a simple pump. Advantageously, the porous molding is designed for an air-flow rate of 0.1 to 1 l/(min. $cm^2_{outlet\ area}$).

The nozzle 1 is used for applying the hot-melt adhesive 2 to the moving web 3 made from a nonwoven. To this end, the stream of air flowing out of the porous guide face 6 is such that it forms between the guide face 6 and the web 3 an air cushion 12 that prevents direct contact between the web 3 and the guide face 6 and enables gentle guidance of the web 3 over the nozzle 1.

We claim:

1. A nozzle for applying a liquid adhesive to a web moving continuously in a travel direction, the nozzle comprising:

a body having a passage forming an outlet that opens generally transversely to the direction immediately adjacent the moving web at a face of the body, whereby the liquid adhesive flows through the passage and out the outlet onto the moving web;

structure forming on the face of the body immediately only upstream of the outlet a porous region; and means for feeding air through the structure and out of the face to form between the porous region and the web an air cushion only upstream of the outlet and hold the web out of contact with the nozzle.

2. The nozzle defined in claim 1, wherein the face forms at the porous region with the web an inflow gap narrowing in the travel direction toward the outlet.

3. The nozzle defined in claim 2, wherein the porous region has relative to the direction a flat upstream subface forming an acute angle with the web and between the upstream subface and the outlet a downstream subface forming with the web an acute angle smaller than that of the upstream subface.

4. The nozzle defined in claim 3, wherein the angle of the downstream subface is approximately 0° .

5. The nozzle defined in claim 2, wherein the porous region has an arcuate surface directed at the web and defining the gap.

6. The nozzle defined in claim 1, wherein the body is provided with a porous element set flush with the face and forming the porous region.

7. The nozzle defined in claim 6, wherein the porous element is of sintered metal.

8. The nozzle defined in claim 1, wherein the porous element has open pores.

9. The nozzle defined in claim 1, further comprising means for supplying a hot-melt adhesive to an upstream end of the passage.

10. The nozzle defined in claim 1, wherein the body is formed with an air passage extending from the porous region and having an upstream end connected to the means for feeding air to the air passage.

* * * * *